US012479059B2

(12) United States Patent
Pope, Jr.

(10) Patent No.: US 12,479,059 B2
(45) Date of Patent: Nov. 25, 2025

(54) WET/DRY CONCRETE GRINDER/POLISHER WITH REMOVABLE/ATTACHABLE SLURRY/DUST COLLECTION ACCESSORIES

(71) Applicant: Refuse Materials, Inc., Ocilla, GA (US)

(72) Inventor: Donald A. Pope, Jr., Ocilla, GA (US)

( * ) Notice: Subject to any disclaimer, the term of this patent is extended or adjusted under 35 U.S.C. 154(b) by 498 days.

(21) Appl. No.: 17/875,997

(22) Filed: Jul. 28, 2022

(65) Prior Publication Data

US 2023/0032463 A1 Feb. 2, 2023

Related U.S. Application Data

(60) Provisional application No. 63/226,274, filed on Jul. 28, 2021.

(51) Int. Cl.
*B24B 7/18* (2006.01)

(52) U.S. Cl.
CPC ..... *B24B 7/186* (2013.01)

(58) Field of Classification Search
CPC ..... B24B 55/06; B24B 55/102; B24B 55/10; B24B 7/186; B24B 7/182; B24B 7/18; B24B 41/02
USPC ..... 451/350
See application file for complete search history.

(56) References Cited

U.S. PATENT DOCUMENTS 3,929,377 A * 12/1975 Weaver ..... E01C 23/088 451/352
4,317,246 A * 3/1982 Knowlton ..... E01H 1/047 414/525.5
4,615,070 A * 10/1986 Frederick ..... E01H 1/0854 15/349
5,302,210 A * 4/1994 Whyte ..... B09C 1/00 15/300.1
7,448,114 B2 * 11/2008 Basham ..... A47L 11/24 15/340.4
7,448,144 B2 * 11/2008 Johnson ..... A61L 9/013 34/79
2007/0207711 A1 * 9/2007 Crocker ..... E01H 1/103 451/434
2018/0242809 A1 * 8/2018 Reccanello ..... A47L 11/4083
2020/0288933 A1 * 9/2020 Pope ..... A47L 11/085

* cited by examiner

*Primary Examiner* — Joel D Crandall
(74) *Attorney, Agent, or Firm* — Fishman Stewart PLLC

(57) ABSTRACT

A walk-behind grinder/polisher receives removably attachable wet and dry debris collection modules. These modules are substantially rigidly attached to the frame of the grinder/polisher and suspended above a floor surface so as to travel with the grinder/polisher when coupled thereto. Each debris collection module removably attaches to a vacuum producer mounted on the frame of the grinder/polisher. An engine drives a first hydrostatic pump in fluid communication with a first hydraulic motor driving the grinding/polishing head in reversible fashion. The engine further drives a second hydrostatic pump in fluid communication with a second hydraulic motor driving the vacuum producer. The dust collection module has an inlet removably attachable to the dust collection port on the shroud, and an outlet coupled to a dust collection canister. The slurry collection module has an inlet removably attachable to a squeegee, and an outlet coupled to a slurry containment vessel.

20 Claims, 8 Drawing Sheets

WET/DRY CONCRETE GRINDER/POLISHER WITH REMOVABLE/ATTACHABLE SLURRY/DUST COLLECTION ACCESSORIES

REFERENCE TO RELATED APPLICATIONS

This application claims priority to, and the benefit of, U.S. Provisional Patent Application Ser. No. 63/226,274, filed Jul. 28, 2021, the entire content of which is incorporated herein by reference.

FIELD OF THE INVENTION

This invention relates generally to concrete grinding and polishing and, in particular, to a grinder/polisher with removably attachable slurry or dust collection accessories.

BACKGROUND OF THE INVENTION

Polished concrete floors are becoming increasingly popular for retailers, big-box stores, educational and medical facilities, and even residential applications. Common uses include warehouses and warehouse outlets, hotels and restaurants, office buildings and showrooms. Benefits include low cost, resistance to wear, low maintenance, and aesthetic appeal in many situations. Polished concrete floors are easy to clean, and the glossy surface of polished concrete resists the marks of forklift truck tires and staining from oil and chemical spills. The glossy appearance of polished concrete is desirable for office building, hotels, restaurants, and other public facilities that want to project a bright, clean, professional image.

Various different types of machines are used to achieve a polished concrete floor, including riding and walk-behind coarse and fine grinders and polishers using wet and dry techniques. Machines are also available for stripping and removing old floors, filling in cracks, applying concrete overlays, as well as slurry and dust collection.

The polishing process itself proceeds through a series of mechanical and grinding stages utilizing professional equipment designed for these purposes. The process may also include the use of a concrete "densifier" which penetrates into the concrete to harden and dustproof the surface. The concrete surface is processed through a series of steps with grinding and polishing disks having progressively finer grits. The disks are typically fabricated with industrial diamonds in a bonded material such as metal, resin or a combination thereof, often referred to as "diamond polishing pads."

Typically the concrete goes through a process of grinding and polishing using aggressive equipment and abrasive elements or tooling, including pads of varying grit from 30 to 3,000. Concrete is considered "polished" until grits of 800 or finer are used, followed by finishing to 1500 3000-grit levels. The concrete may be ground without entering aggregate layers, or different sizes of aggregate may be exposed and polished to achieve different appearances. Dyes designed for concrete polishing are often applied to add color to polished concrete for borders, logos and decorative patterns. Such options provide a wide range of surface finish and color variations.

Concrete grinding and polishing begins with grinding pads or tools that have grits of 30, 70, and 120, which are used successively. These abrasive elements are rotated at a relatively slow speed during the grinding steps, e.g., at rotating speeds in the range of about 500 to 800 rpm. After grinding with the diamond pads, honing steps follow using grits of 50, 100, and 200, rotated at, for example, a speed of about 800 rpm. After about 200-grit honing step, dies or stains may be applied and, if necessary, a concrete densifier may be applied to the floor.

Polishing continues using a 400 grit or finer pad, with rotational speeds of the spindles and abrasive elements being in the range of about 800 to 1,100 rpm. The concrete will begin to develop a sheen, with the grit choice of the final polishing steps being dependent upon the reflection and shine desired. If the polishing process is continued through use of a 3000-grit pad, the concrete will assume a mirror-like finish. Burnishing may further promote a specular appearance. A topical sealer may be optionally applied to the finished floor.

The grinding and polishing steps may be dry or wet. With the latter, a water tank on-board the grinding/polishing machine delivers water to the diamond pads or resin pads through channels to the polishing head. With wet polishing, the generated slurry is collected with a squeegee, and with dry polishing the dust is collected with a vacuum. Typically, the polishing head is enclosed with a shroud that surrounds the rotating pads. A vacuum port is connected with a hose to an externally-provided vacuum, which may be nearby or wheeled alongside the grinding and polishing machine.

Although wet and dry techniques both have advantages and disadvantages, dry polishing tends to be faster, more convenient, and environmentally friendly. Wet polishing uses water to cool the diamond abrasives and eliminate grinding dust. The water acts as a lubricant to reduce friction, but cleanup is more involved. Wet polishing creates a tremendous amount of slurry that crews must collect and dispose of in an environmentally sound manner. With dry polishing, no water is required. Instead, the floor polisher is hooked up to a dust-containment system that vacuums up the mess.

In summary, the process of concrete floor polishing may include some or all of the following steps:

- Remove existing coating(s);
- Deposit new layer of concrete onto uneven or damaged floor;
- Seal cracks, joints or imperfections with an epoxy or other semi-rigid filler;
- Progressively grind with a 30/40-, 80- and 150-grit metal-bonded diamond pads;
- Optionally apply a chemical hardener to densify the concrete;
- Progressively polish with a 100/200-, 400- and 800-grit resin or metal-bonded diamond pads;
- Apply optional dye(s) for coloration;
- Finish with a 1500- or 3000-grit resin-bonded diamond pads to achieve a desired sheen level; and
- Optionally seal

SUMMARY OF THE INVENTION

This invention simplifies and therefore expedites floor grinding and polishing by providing a walk-behind grinder/polisher equipped with all structural and functional hardware needed to receive removably attachable debris collection modules. These modules are substantially rigidly attached to the frame of the grinder/polisher and suspended above a floor surface so as to travel with the grinder/polisher when coupled thereto.

The system may broadly attach to either a (wet) slurry collection module or a (dry) dust collection module. In each case, the debris collection module removably attaches to a vacuum producer mounted on the frame of the grinder/polisher.

The grinder/polisher includes an engine such as a propane engine mounted on the frame. In preferred embodiments, the engine drives a first hydrostatic pump in fluid communication with a first hydraulic motor driving the grinding/polishing head in reversible fashion. The engine further drives a second hydrostatic pump in fluid communication with a second hydraulic motor driving the vacuum producer.

The dust collection module has an inlet removably attachable to the dust collection port on the shroud, and an outlet coupled to a dust collection canister. The slurry collection module has an inlet removably attachable to a squeegee, and an outlet coupled to a slurry containment vessel.

DETAILED DESCRIPTION OF THE INVENTION

As mentioned in the Background of the Invention, concrete grinding and polishing may use wet or dry processes. Wet polishing creates a tremendous amount of slurry that crews must collect and dispose of in an environmentally sound manner. With dry polishing, no water is required, but the floor polisher must be hooked up to a dust-containment system that vacuums up the mess. Typically, the polishing head is enclosed with a shroud that surrounds the rotating pads. A vacuum port is connected with a hose to an externally-provided vacuum, which may be nearby or wheeled alongside the grinding and polishing machine.

Thus, both wet and dry grinding and polishing processes require ancillary equipment to suction or vacuum the removed material. This is inconvenient, requiring hoses and connections between the equipment. Moreover, these hoses and connections often get covered in slurry or dust and further complicate the cleanup process.

This invention solves such issues with the prior art by providing a modular wet/dry grinding/polishing machine to which a slurry suction or dust vacuum unit may be removably attached, thereby eliminating the need for separate equipment and the connections therebetween. In the preferred embodiments, the machine is a propane-powered walk-behind unit with a true planetary grinding/polishing head.

Figure 1:
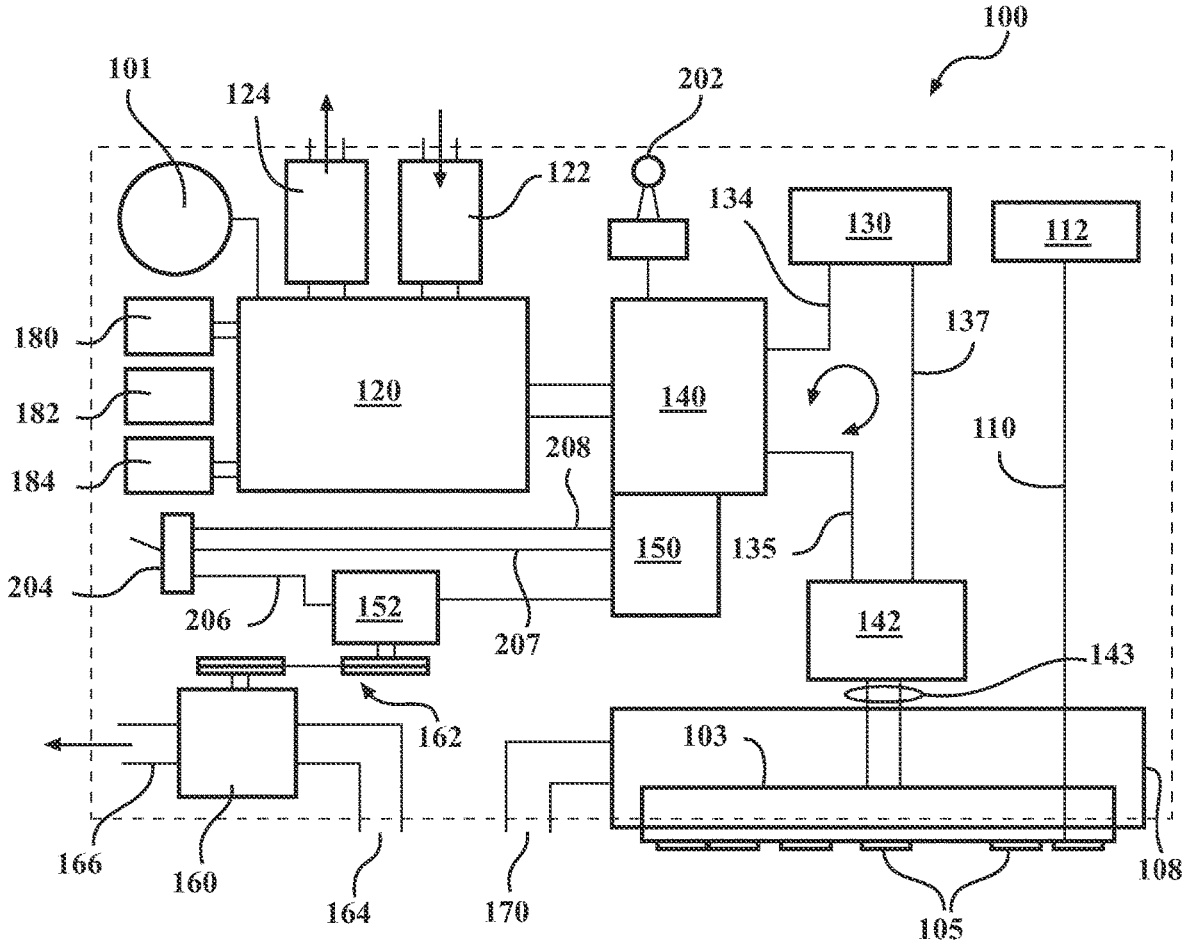
FIG. 1 is a simplified schematic diagram of a preferred embodiment of a grinder/polisher configured in accordance with the invention without slurry or dust collection attachments.

Before presenting detail drawings of the machine and attachments, FIG. 1 is a simplified schematic diagram of the grinder, depicted generally at 100, but without the slurry or dust collection attachments. The machine is powered by engine 120, preferably a propane engine such as a Briggs & Stratton 36-hp, two-cylinder propane engine. Other makes and models may be used assuming sufficient horsepower. Reference 101 illustrates an on-board propane tank. Item 122 represents an air-intake manifold, and 124 depicts an exhaust manifold, preferably with a catalytic muffler to reduce emissions. The system further includes a starter 180, battery 182, and alternator 184.

Motor 120 drives a hydrostatic pump 140 which in turn powers hydraulic motor 142. Motor 142 is coupled to pad 103 containing grinding/polishing elements 105. The invention may be used with removable/replaceable diamond elements or resin-bonded elements of any grit intended for wet or dry grinding or polishing. Motor 142 may be coupled to pad 103 through device 143 which may represent a gear box, lovejoy coupler, or the like. Pad 103 is surrounded by shroud 108 including a dust evacuation port 170. When wet processing is used, elements 105 are cooled and lubricated with water from tank 112 through line 110.

Being hydrostatic, pump 140 may be operated in either direction. Indeed, control 202 facilitates two forward speeds, neutral and reverse. The setting of control 202 causes fluid to flow to or from reservoir 130 through hydraulic lines 134, 135, 137, to set the speed and direction of pad 103 (or no rotation in the neutral position).

Coupled to hydrostatic pump 140 is a smaller, unidirectional hydraulic pump 150. Pump 150 controls the operation of hydraulic motor 152 which, in turn, drives vacuum producer 160. Any coupling may be used, including direct, gears or pulley 162 as shown. Vacuum producer 160 includes an input 164 and output 166. Inlet connection 164 may accommodate a 2" hose, though other sizes may alternatively be accommodated.

Control 204 enables an operator to turn the vacuum producer 160 ON and OFF. In one position, fluid flows from pump 150 through motor 152 through lines 208, 206, while, in the other position, fluid is routed back to pump 150 through line 207, bypassing motor 152. Note that, in the preferred embodiment, motors 142, 152 may be bent-axis hydraulic motors with the understanding that other motor types may alternatively be used.

Figure 2:
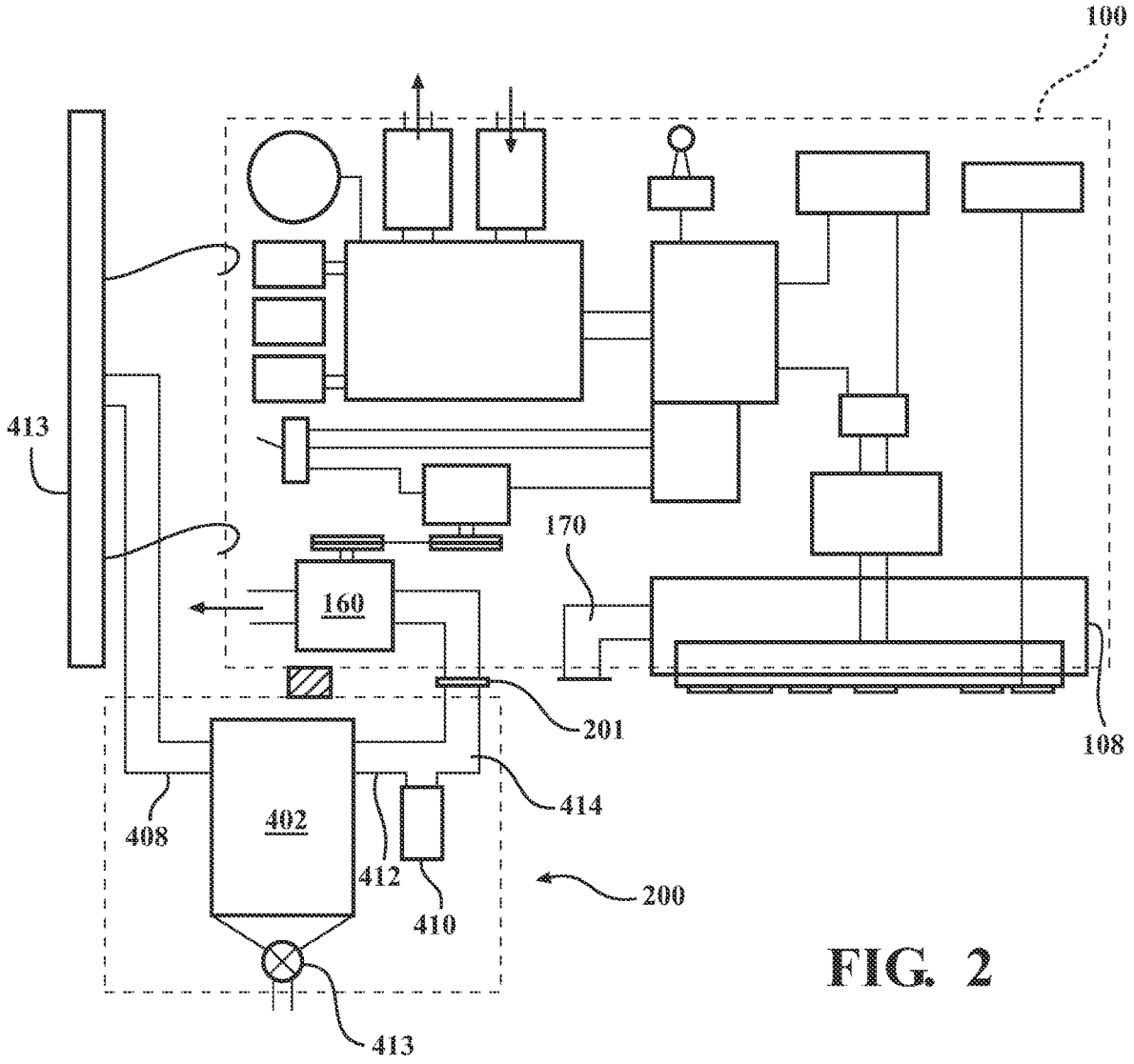
FIG. 2 is a simplified schematic diagram of the preferred embodiment with a slurry collection attachment.

FIG. 2 is a simplified schematic diagram of the preferred embodiment with a slurry collection attachment 200. Note that, as with the dry collection attachment described below, the frame of the collection attachment is rigidly coupled to the frame of the main unit, such that the attachment moves along with the machine without the need for any ground-contacting cables or hoses.

Unit 200 in this embodiment makes a connection to the vacuum producer 160 through hose coupling 201. The opening 170 to the shroud 108 would be blanked off. The vacuum is coupled to slurry tank 402 through conduits 414, 412, which preferably includes a visualization gauge 410 enabling an operator to see if any unwanted liquid may be entering the on-board vacuum system. Containment vessel 402 is further coupled to a walk-behind slurry collection squeegee 413 through hose 408. Squeegee 413 conveniently hangs on the back of the frame of the main unit 100. Tank 402 further includes a ball valve 403 enabling the slurry to be discharged and disposed of. Note that the equipment may continue uninterrupted operation immediately after emptying the tank 402.

Figure 3:
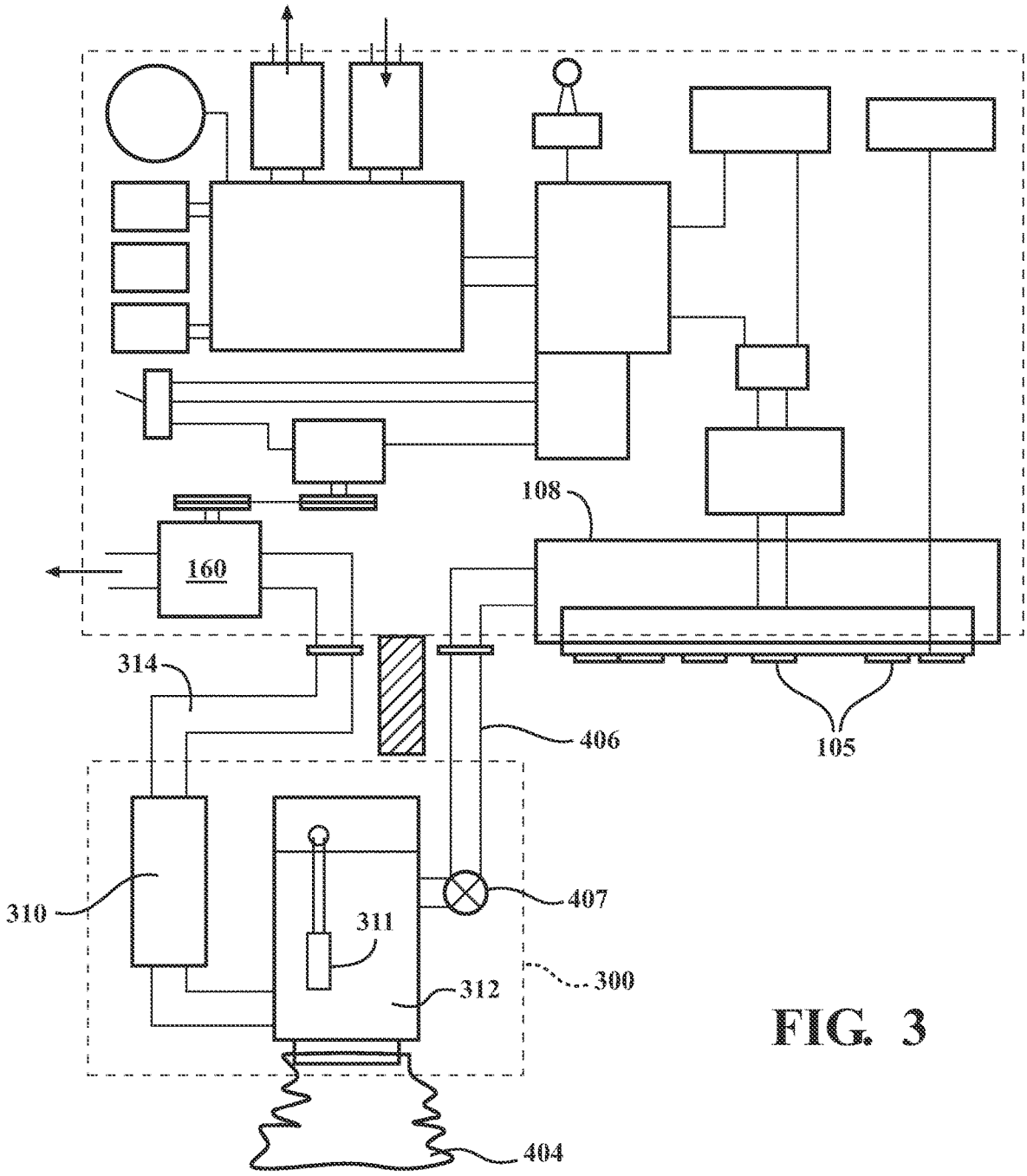
FIG. 3 is a simplified schematic diagram of the preferred embodiment with a dust collection attachment.
Figure 4:
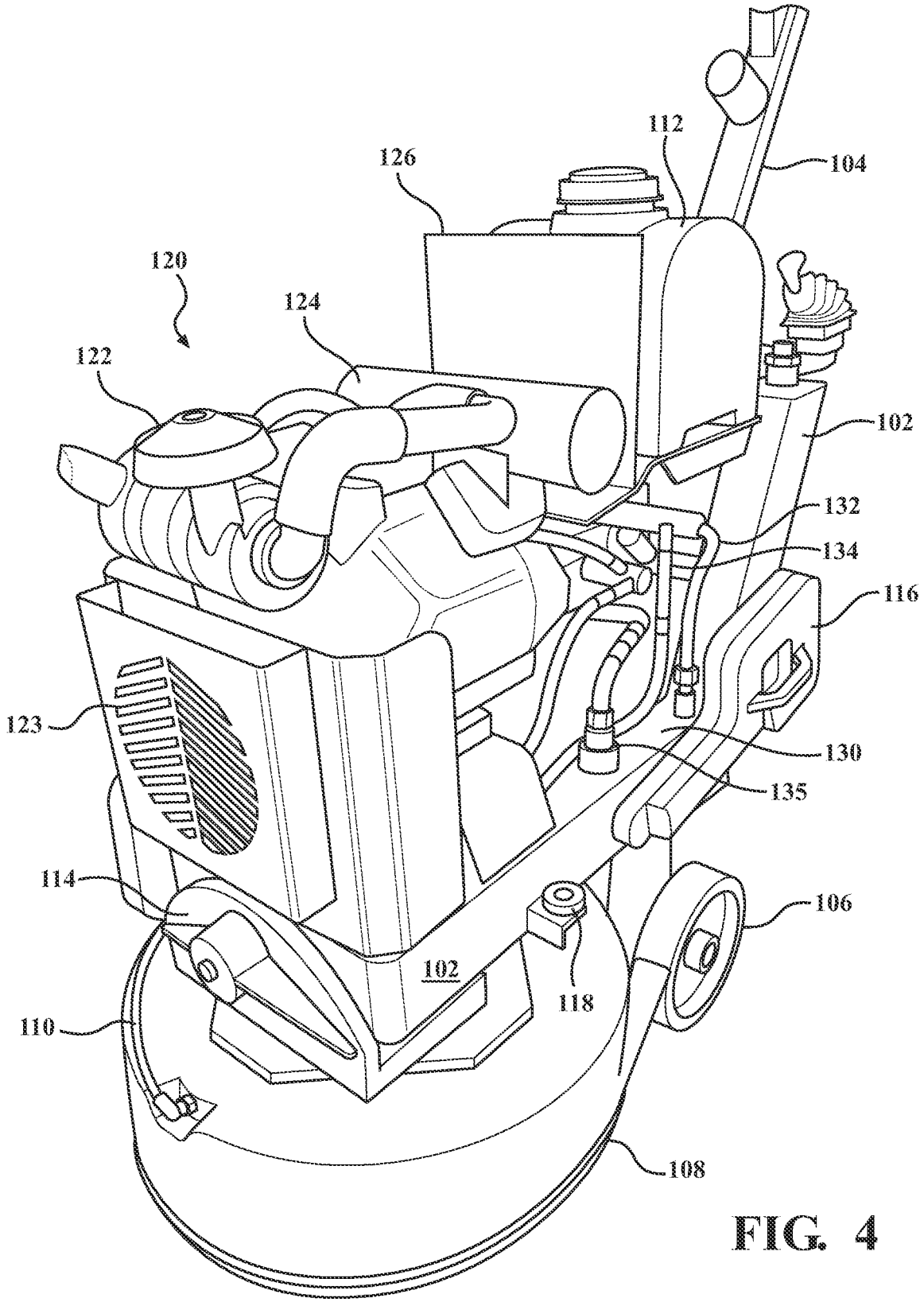
FIG. 4 is front, side perspective view of a prototype machine without slurry or dust collection attachments.
Figure 5:
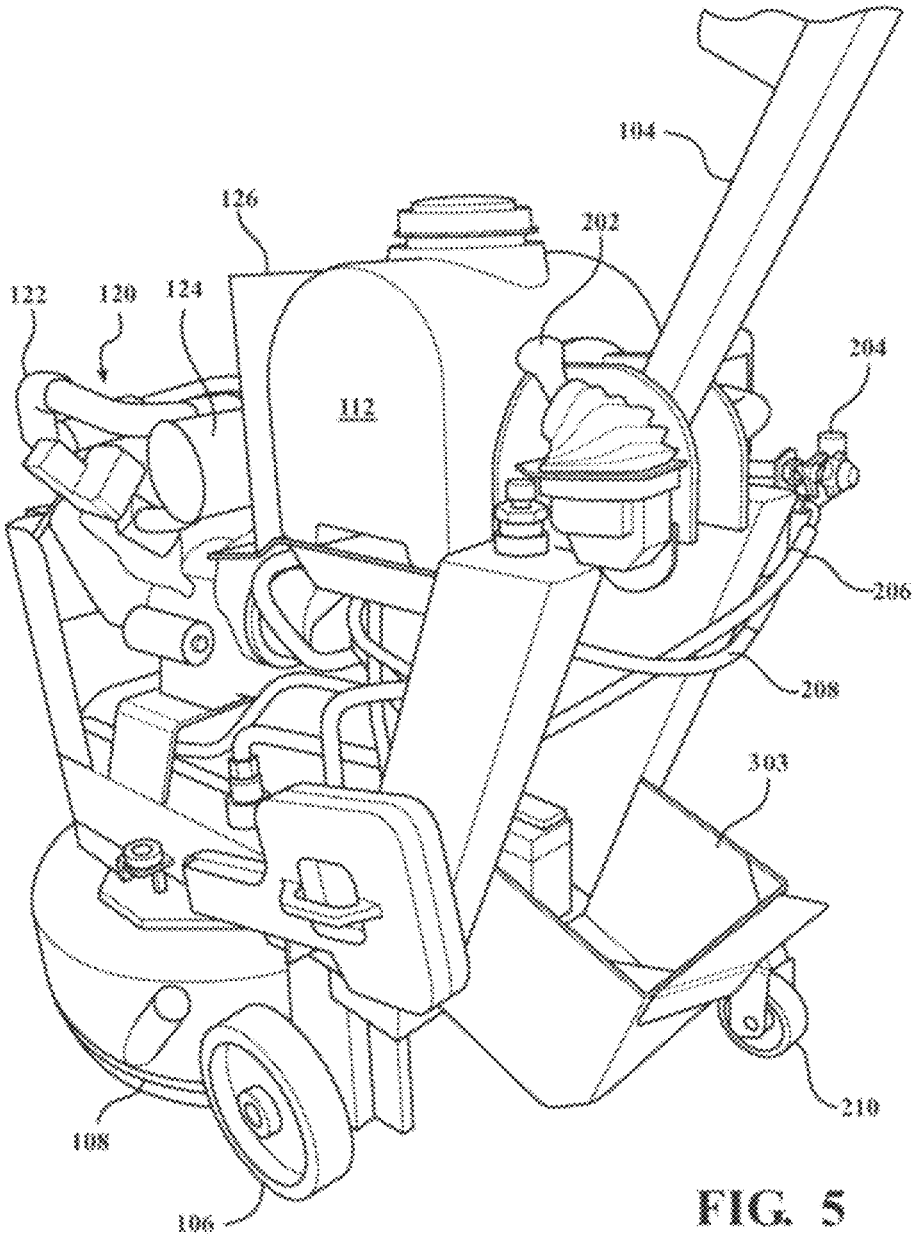
FIG. 5 is rear, side perspective view of a prototype machine without slurry or dust collection attachments.

FIG. 3 is a simplified schematic diagram of the preferred embodiment with a dust collection attachment. As with the slurry collection module, the frame 300 of the dust collection system makes a rigid connection to the frame of the main unit 100 such that the collection system travels with the main unit. In this embodiment, two hose connections are made to the main unit, including a first connection through hose 406 to shroud 108, and a second connection through hose 314 to vacuum producer 160.

Dust from the abrasive elements 105 first enter a prefilter 312, followed by a HEPA filter 310. HEPA filter 310 contains a cartridge in a canister which is removed and disposed of. To clean prefilter 312, the line 406 from the polishing head is blanked off with valve 407, and handle 311 is moved to empty the contents of the prefilter into disposal bag 404. The canister associated with prefilter 312 may also be opened to removed and replace the filter cartridge. As with the slurry vacuum attachment, following cleaning the system may resume normal operation.

FIGS. 4-8 show a machine according to the invention, wherein the following numerical references refer to the various component parts:

FIG. 4

102—Main frame
104—Portion of handle bar
112—Water tank
126—Heat shield
124—Catalyst exhaust/muffler
120—Engine
122—Engine air filter housing
123—Hydraulic cooling fan
114—Planetary head mount/swivel
110—Water line for diamonds
108—Dust shroud
118—Bumper/stop for weights in forward position
106—Wheels
130—Frame and also hydraulic oil reservoir
134—Hydrostat oil supply
135—Hydraulic line between hydrostat and hydraulic motor 142
116—Weights
132—Gear pump oil supply

FIG. 5

108—Dust shroud
106—wheel
210—Caster wheel to ease the movement of the machine when not grinding
303-Propane tank holder
208—Vacuum control valve oil feed from gear pump
206—Oil feed to the vacuum hydraulic motor
204—Vacuum producer control valve to turn it off/on
104—Handle bar
202—Hydrostat control lever to turn on the planetary gearbox and change speed/direction
112—Water tank
124—Catalyst exhaust muffler
120—Engine
122—Engine air filter housing

FIG. 6

Figure 7:
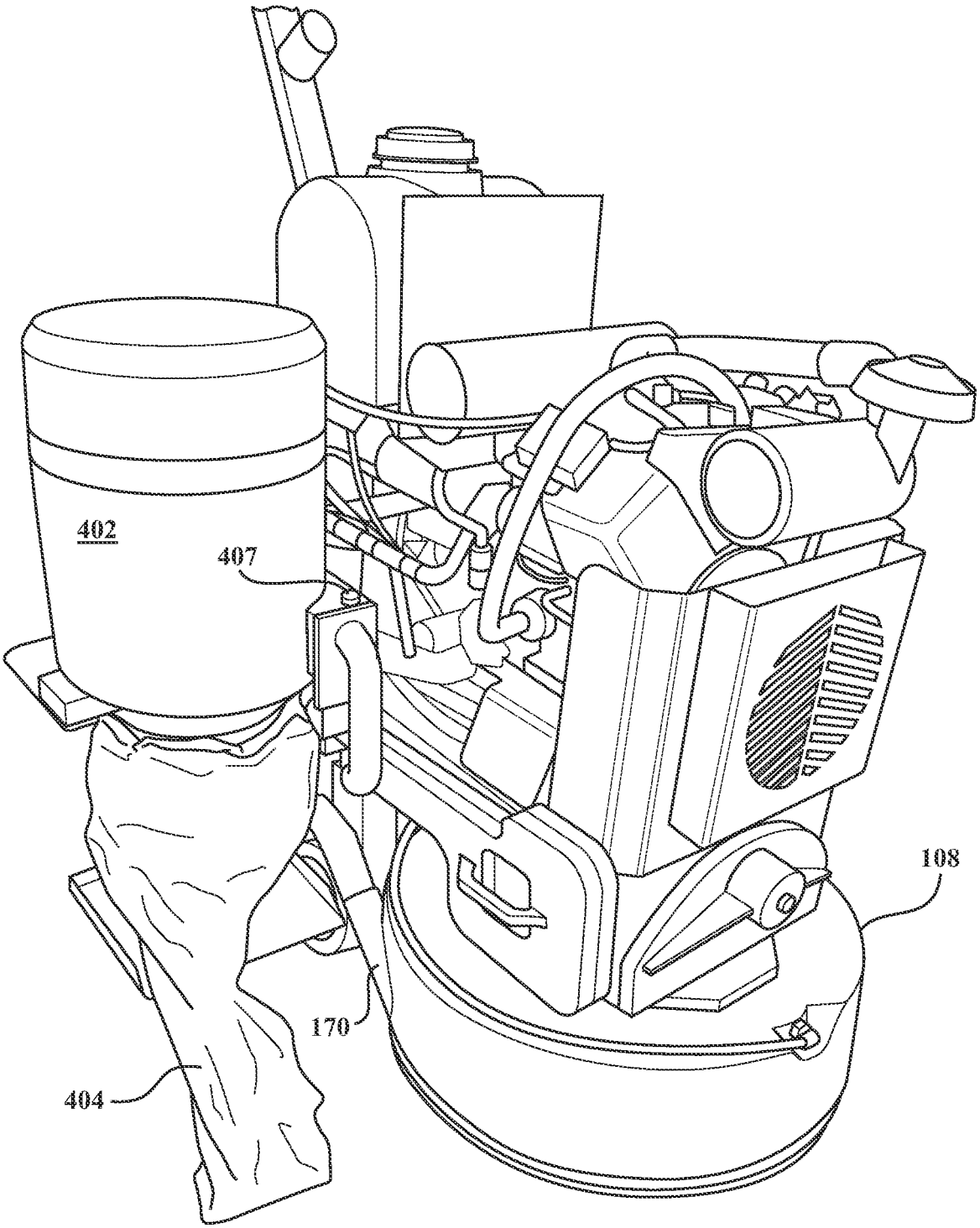
FIG. 7 is a front, side perspective view showing the dust collection attachment.

303-Propane tank holder
304—Accessory lock pin
302—Accessory receiver
106—wheel
306—Vacuum tank frame
309—Hose connection to prefilter 312
310—HEPA filter housing
312—Main vacuum filter housing
314—Connection hose from vacuum producer
122—Engine air filter housing
112—Water Tank
316—Engine throttle FIG. 7—Dry Collection Attachment

Figure 8:
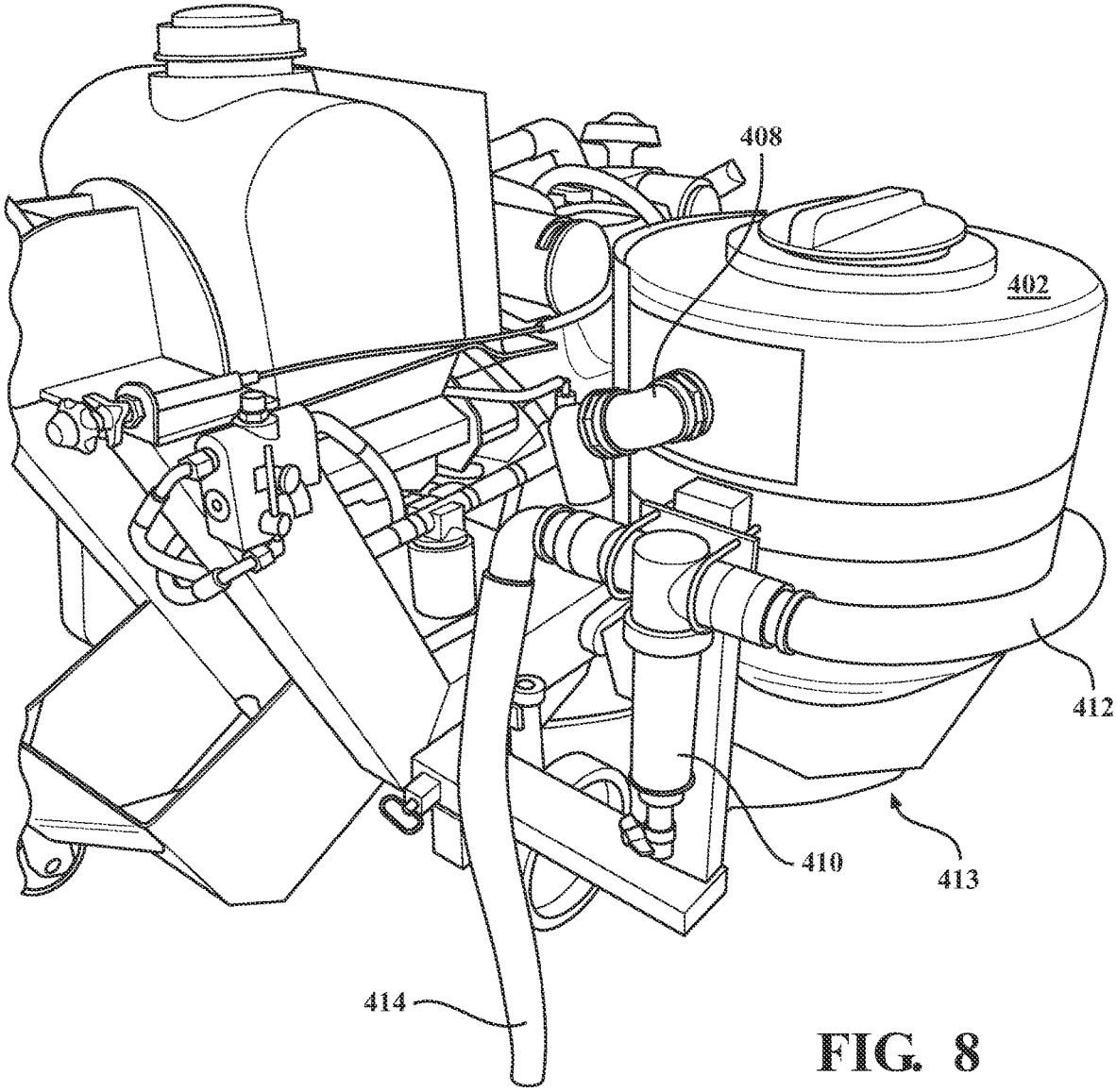
FIG. 8 is a side perspective view showing a slurry collection attachment.

402—Main vacuum filter housing
406—Hose connection from vacuum tank to dust shroud
404—Debris/dust collection bag
407—Inlet blank FIG. 8—Wet Collection Attachment

416—Hose connection from floor squeegee to tank
414—Hose connection to Vacuum producer
410—Water separator between vacuum producer and collection tank
412—Hose connection from water separator to collection tank
402—Wet slurry collection tank
408—Floor squeegee connection port While FIGS. 4-8 do not show all of the components specified in the block diagrams of FIGS. 1-3, operation should be understood from the above description. For example, the photos do not show the grinding/polishing head itself, but the invention is not limited in this regard. In the preferred embodiments, the grinding/polishing head is a true planetary head adapted to receive resin or industrial diamond elements with differing grits from course to fine. Planetary floor grinders are generally lighter rotary grinders and are therefore easier to operate and maneuver. As opposed to a rotary grinder, a planetary grinder features a large main disc that acts as a central point around which several small discs rotate at different speeds, simultaneously grinding or polishing the surface.

During operation of the grinder/polisher machine, weights 116 on both sides are positioned forwardly onto bumpers 118, transferring weight to the grinding head. To change the pads or grinding/polishing elements, however, the weights are moved back as shown, making it easier to tilt the machine back on caster wheel 210. Caster wheel 210 in FIG. 5 also eases movement of the machine when not grinding.

Figure 6:
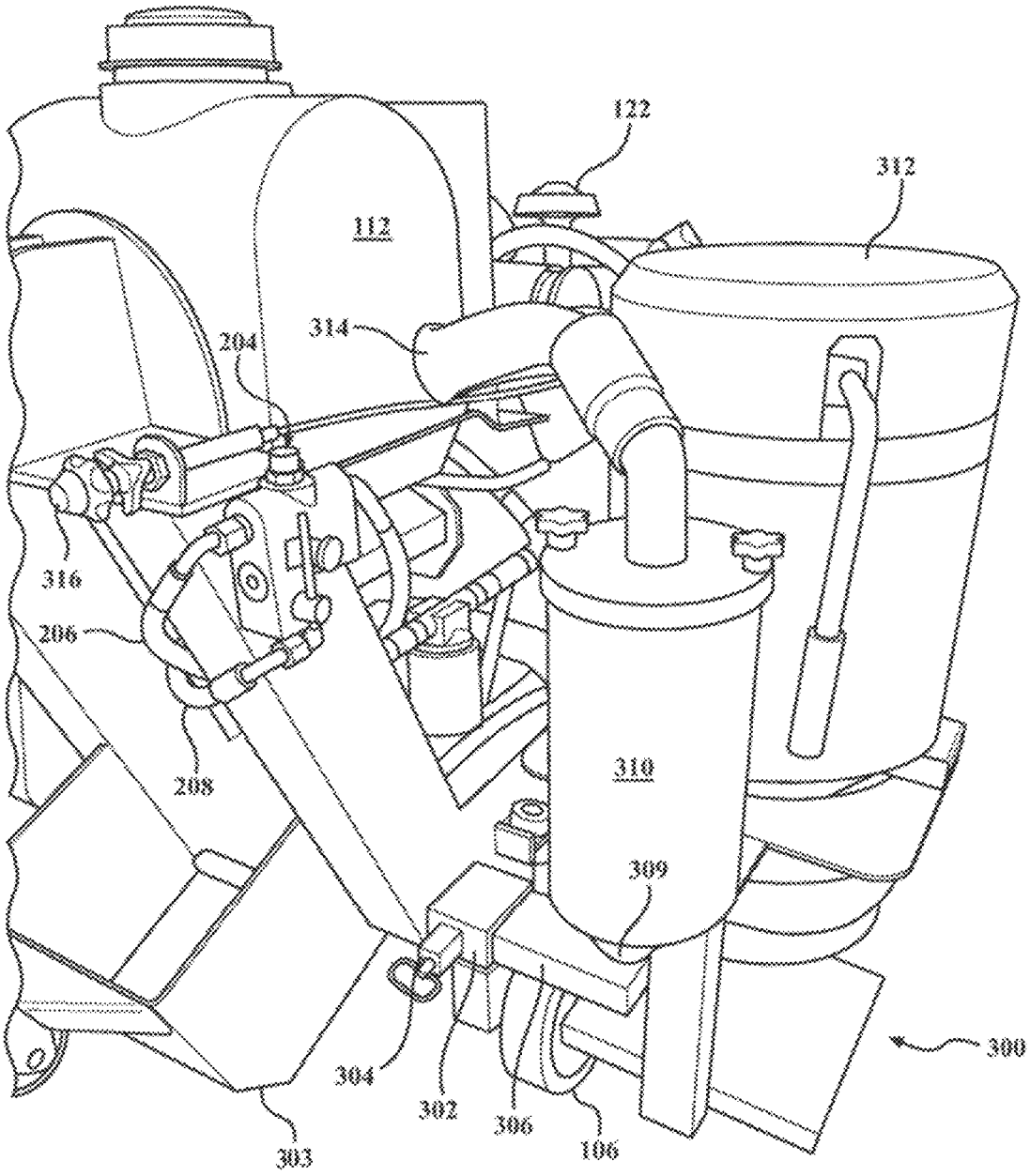
FIG. 6 is a side perspective view showing a dust collection attachment.

FIG. 6 is a side perspective view showing a dust collection attachment 300, which includes a prefilter 312 followed by a HEPA filter 310. The attachment is typically brought up to the frame of the main machine by two persons, enabling accessory frame portion 306 to slide into receiver 302 and locked with pin 304, much like a vehicular trailer hitch configuration. Following mounting of the accessory, hose 314 is connected to the vacuum producer of the main frame (not visible in the photos). Also not visible is a hose attachment between prefilter 312 and HEPA filter at 309.

FIG. 7 is a front, side perspective view showing the dust collection attachment. Dust outlet from shroud 108 connects to the inlet of prefilter 402 through port 170 and into inlet blocker 407. With the inlet blocked, handle 311 in FIG. 6 is pivoted, allowing the contents of the filter to drop into collection bag 404 when attached.

FIG. 8 is a side perspective view photo showing a wet slurry collection attachment. The accessory couples to the same receiver 302 and is held in position with pin 304. In this case, hose 414 connects to the vacuum producer (not visible), and continues to the slurry collection vessel 402 through line 412. A transparent water separator 410 between the vacuum producer and collection tank enables a user to see is water or slurry may be making its way into the vacuum producer, in which case the system would be shut down for tank emptying or maintenance. Hose connection 408 connects to the walk-behind floor squeegee, also not shown in the photos.

The invention claimed is:

1. A walk-behind abrasive system, for surfacing or resurfacing, the system being configured to receive a collection attachment, the system comprising:

a first frame with opposing side wheels and a handlebar;

an engine mounted on the first frame, driving an abrasive head disposed beneath the first frame;

a shroud surrounding the abrasive head, the shroud comprising a dust collection port;

a vacuum producer mounted on the first frame and driven by the engine, the vacuum producer comprising an inlet port and an outlet port; and at least one mechanical receiver on the first frame, configured to receive a second frame of the collection attachment, wherein the at least one mechanical receiver comprises at least one slot, the least one slot being configured to guide and retain the second frame of the collection attachment, and wherein the collection attachment is removably engaged with the system by sliding the second frame into the at least one slot and establishing fluid communication between the collection attachment and the vacuum producer.

2. The system of claim 1, wherein the engine drives a hydrostatic pump in fluid communication with a hydraulic motor driving the abrasive head.

3. The system of claim 2, wherein the hydraulic motor is reversible.

4. The system of claim 1, wherein the engine drives a hydrostatic pump in fluid communication with a hydraulic motor driving the vacuum producer.

5. The system of claim 1, wherein the collection attachment comprises an inlet removably attachable to the dust collection port on the shroud, and an outlet coupled to a dust collection canister.

6. The system of claim 1, wherein the collection attachment comprises an inlet removably attachable to a squeegee, and an outlet coupled to a slurry containment vessel.

7. The system of claim 1, wherein:

the engine drives a first hydrostatic pump in fluid communication with a first hydraulic motor driving the abrasive head, and the engine drives a second hydrostatic pump in fluid communication with a second hydraulic motor driving the vacuum producer.

8. The system of claim 1, wherein the abrasive head comprises at least one abrasive pad.

9. The system of claim 1, wherein the collection attachment is a dust collection attachment.

10. The system of claim 1, wherein the collection attachment is a slurry collection attachment.

11. The system of claim 10, further comprising a blank off plate configured to block the dust collection port.

12. The system of claim 1, further comprising at least one pin to secure the second frame in the at least one slot.

13. A walk-behind abrasive system for surfacing or resurfacing, the system comprising:

a first frame with opposing side wheels and a handlebar;

an engine mounted on the first frame driving an abrasive head disposed beneath the first frame;

a shroud surrounding the abrasive head including a dust collection port;

a vacuum producer mounted on the first frame and driven by the engine, the vacuum producer comprising an inlet port and an outlet port;

a plurality of collection attachments comprising a dust collection attachment and a slurry collection attachment, the dust collection attachment including a second frame, the slurry collection attachment including a third frame;

at least one mechanical receiver on the first frame;

wherein, for dry application, the dust collection attachment is removably secured to the first frame by sliding the second frame into the receiver of the first frame, wherein the dust collection attachment comprises an inlet removably attachable to the dust collection port on the shroud and an outlet coupled to a dust collection canister, wherein, for wet application, the slurry collection attachment is removably secured to the first frame by sliding the third frame into the receiver of the first frame, and wherein the slurry collection attachment comprises an inlet removably attachable to a squeegee and an outlet coupled to a slurry containment vessel.

14. The system of claim 13, wherein the engine drives a hydrostatic pump in fluid communication with a hydraulic motor driving the abrasive head.

15. The system of claim 14, wherein the hydraulic motor is reversible.

16. The system of claim 13, wherein the engine drives a hydrostatic pump in fluid communication with a hydraulic motor driving the vacuum producer.

17. The system of claim 13, wherein the abrasive head comprises at least one abrasive pad.

18. The system of claim 13, further comprising at least one pin to secure the second frame in the receiver.

19. The system of claim 13, further comprising at least one pin to secure the third frame in the receiver.

20. The system of claim 13, further comprising a blank off plate configured to block the dust collection port for the wet application.

* * * * *